US008864595B2

(12) United States Patent
Ochi

(10) Patent No.: US 8,864,595 B2
(45) Date of Patent: Oct. 21, 2014

(54) SLIDE DEVICE

(75) Inventor: Yasushi Ochi, Kaizuka (JP)

(73) Assignee: BLD Oriental Co., Ltd., Izumisano Osaka Prefecture (JP)

( * ) Notice: Subject to any disclaimer, the term of this patent is extended or adjusted under 35 U.S.C. 154(b) by 82 days.

(21) Appl. No.: 13/497,085

(22) PCT Filed: Apr. 21, 2010

(86) PCT No.: PCT/JP2010/002875
§ 371 (c)(1),
(2), (4) Date: Jul. 25, 2012

(87) PCT Pub. No.: WO2011/058670
PCT Pub. Date: May 19, 2011

(65) Prior Publication Data

US 2012/0283033 A1 Nov. 8, 2012

(30) Foreign Application Priority Data

Nov. 13, 2009 (JP) ..... 2009-259839

(51) Int. Cl.
*A63G 21/00* (2006.01)
*A63G 21/18* (2006.01)

(52) U.S. Cl.
CPC ..... *A63G 21/18* (2013.01)
USPC ..... 472/116

(58) Field of Classification Search
CPC ..... A63G 21/18; A63G 21/00
USPC ..... 472/116, 117, 128
See application file for complete search history.

(56) References Cited

U.S. PATENT DOCUMENTS 4,484,739 A * 11/1984 Kreinbihl et al. ..... 472/88
4,805,898 A * 2/1989 Jacober et al. ..... 472/117

(Continued)

FOREIGN PATENT DOCUMENTS

EP 2058030 A1 5/2009
JP 111677/1977 U 3/1979

(Continued)

OTHER PUBLICATIONS

International Search Report; Application No. PCT/JP2010/002877; Jun. 22, 2010; Japanese Patent Office.
Naoki Turuoka; Written Opinion of the International Searching Authority; Application No. PCT/JP2010/002877; Jun. 22, 2010; Japanese Patent Office.

(Continued)

*Primary Examiner* — Michael Dennis
(74) *Attorney, Agent, or Firm* — Stevens & Showalter, LLP

(57) ABSTRACT

Present invention is provided with a slide main body 100; a support supporting a upper portion of the slide main body; a reservoir 131 for mechanism circulating fluids such as the water to the slide main body 100; a water supply pump 133; and a pipe 140, a slide main body having a hollow structure opened on a lower portion; a reservoir supporting the opening of lower portion of the slide main body; a reservoir 131 is provided in the water supply pump 133.

And, a pipe placed in the hollow portion of the slide main body, one end of the pipe connecting to a discharge opening of the water supply pump, and the other end of the pipe extended to the upper inside of the slide main body; a nozzle connected to the other end of the pipe; the nozzle spurting the fluid filled with the reservoir via the pipe, the reservoir being returned the spurting fluid, the spurting/returning is repeated.

6 Claims, 5 Drawing Sheets

(56) References Cited

U.S. PATENT DOCUMENTS

| | | | | |
|---|---|---|---|---|
| 5,407,393 | A | 4/1995 | Schmidt | |
| 6,582,315 | B1 | 6/2003 | Formanski | |
| 7,431,654 | B2 * | 10/2008 | Ochi | 472/117 |
| 2003/0190967 | A1 * | 10/2003 | Henry | 472/128 |
| 2009/0012122 | A1 | 1/2009 | Branch et al. | |
| 2010/0048310 | A1 | 2/2010 | Ochi | |

FOREIGN PATENT DOCUMENTS

| | | | |
|---|---|---|---|
| JP | 139254/1978 | U | 4/1980 |
| JP | 125903/1982 | U | 4/1984 |
| JP | 62-129072 | A | 6/1987 |
| JP | 73404/1989 | U | 2/1991 |
| JP | 4-15989 | U | 2/1992 |
| JP | H07-098782 | A | 4/1995 |
| JP | 7-265548 | A | 10/1995 |
| JP | 8-38649 | A | 2/1996 |
| JP | 8-211330 | A | 8/1996 |
| JP | H08-196747 | | 8/1996 |
| JP | 8-229244 | A | 9/1996 |
| JP | 2009108449 | A | 4/1997 |
| JP | H11-299635 | | 11/1999 |
| JP | 2000-116959 | A | 4/2000 |
| JP | 2000167254 | | 6/2000 |
| JP | 2000-197715 | | 7/2000 |
| JP | 2001-169864 | A | 6/2001 |
| JP | 2004-208844 | A | 7/2004 |
| JP | 2005-52305 | A | 3/2005 |
| JP | 2005-131215 | A | 5/2005 |
| JP | 2008067741 | A | 3/2008 |
| JP | 2008073497 | A | 4/2008 |
| JP | 2008536082 | A | 9/2008 |
| JP | 2008231904 | A | 10/2008 |
| JP | 200911421 | A | 1/2009 |
| WO | 2006025108 | A1 | 3/2006 |

OTHER PUBLICATIONS

Ochi, Yasushi; U.S. Appl. No. 13/497,070; Apr. 21, 2010 I.A. Date; entitled Tree-Shaped Decoration Apparatus.

Ochi, Yasushi; U.S. Appl. No. 13/497,081; Apr. 21, 2010 I.A. Date; entitled Rotating Amusement Apparatus.

Ochi, Yasushi; U.S. Appl. No. 13/497,116; Apr. 21, 2010 I.A. Date; entitled Rocking Play Device.

Ochi, Yasushi; U.S. Appl. No. 13/497,095; Apr. 21, 2010 I.A. Date; entitled Amusement Apparatus.

Ochi, Yasushi; U.S. Appl. No. 13/497,102; Apr. 21, 2010 I.A. Date; entitled Amusement Apparatus.

International Search Report; Application No. PCT/JP2010/002878; May 25, 2010; Japanese Patent Office.

Yosiaki Usui; Written Opinion of the International Searching Authority; Application No. PCT/JP2010/002878; May 25, 2010; Japanese Patent Office.

International Search Report; Application No. PCT/JP2010/002875; Jun. 1, 2010; Japanese Patent Office.

International Search Report; Application No. PCT/JP2010/002872; Jun. 1, 2010; Japanese Patent Office.

Makoto Suzuki; Written Opinion of the International Searching Authority; Application No. PCT/JP2010/002872; Jun. 1, 2010; Japanese Patent Office.

International Search Report; Application No. PCT/JP2010/002873; Jun. 8, 2010; Japanese Patent Office.

Tamotu Sakai; Written Opinion of the International Searching Authority; Application No. PCT/JP2010/002873; Jun. 8, 2010; Japanese Patent Office.

International Search Report; Application No. PCT/JP2010/002876; Jul. 6, 2010; Japanese Patent Office.

Tuneaki Oota; Written Opinion of the International Searching Authority; Application No. PCT/JP2010/002876; Jul. 6, 2010; Japanese Patent Office.

* cited by examiner

SLIDE DEVICE

TECHNICAL FIELD

This invention relates to a playground apparatus, particularly, the invention relates to a slide apparatus which users such as children can slide down.

BACKGROUND ART

Conventionally, such slide apparatus which can be installed in amusement grounds (called the water slider) known to date include the example disclosed in Japanese Unexamined Pat. App. Pub. No. 2000-167254. The slide apparatus in this instance is provided with a running water device provided on a downhill surface of the slide. A user slides down with flowing water on a downhill surface.

SUMMARY OF THE INVENTION

Problem Invention is to Solve

With the above water slide, however, the apparatus is not able to be installed in a room because it requires a large quantity of water, and large-scale. Also, the water flows on a downhill surface, and a user and the frictional resistance with the downhill surface decrease, causing faster downhill speed.

It is suitable for a fully-developed young person, but an infant is not able to use it, brought about in view of the circumstance described above. An object of the present invention, brought about in view of the circumstance described above, is to make available a slide apparatus entertaining an infant easily and available to be installed in a room.

Means for Resolving the Problem

A slide apparatus of the present invention to achieve the above object, is provided with: a slide main body; a support for supporting a upper portion of the slide main body; a mechanism for circulating fluids such as water to the slide main body, such as a reservoir water supply pump, a pipe, and a nozzle. A slide main body is a hollow structure opened on a lower portion, a reservoir supports an opening of the lower portion of the slide main body, the reservoir includes a water supply pump. And a pipe is placed in the hollow portion of the slide main body, one end of the pipe connects to a discharge opening of the water supply pump, and the other end of the pipe extends to the upper inside of the slide main body. A nozzle is connected to the other end of the pipe. A support supports an upper portion of the slide main body, the nozzle spurts the fluid filled with the reservoir via the pipe, the reservoir is returned the spurting fluid, and it is characterized that the spurting and returning are repeated.

A slide main body is configured to a hollow structure opened on a lower portion. The reservoir is provided below the slide main body, and pumps up the fluid in the reservoir with the water supply pump to the upper inside of the slide main body. The fluid is pumped via a pipe coupled with the discharge opening of the water supply pump, is jetted from a nozzle connected to the other end of the pipe. Therefore, a fluid can be circulated in slide main body by just only preparing a fluid for the reservoir.

In accordance with an aspect of the present invention, a ramp portion is provided in the reservoir, and a suction opening of the water supply pump is placed below the ramp portion so that the capacity of a fluid storing in a tank decreases for the ramp portion. In accordance with an aspect of the present invention, the support is desirable to be a mounting arranged in an echelon form, and it is desirable that a member is provided on a upper of the mounting for preventing a user's falling. And, a shock absorber is coated in a part of the slide apparatus, and a gum resin can apply to a surface of the shock absorber. Also the shock absorber is desirable to be an urethane.

Effects of the Invention

A slide apparatus of the present invention, can circulate a fluid to a slide main body of the hollow structure that is open at a lower portion. This invention can provide a slide apparatus which can give a feeling that a user is using a so called water slide. Also the slide apparatus of this Invention can be installed in a room easily, because it require no large quantity of water. In addition, a playground equipment with excellent ability of maintenance such as repair and change can be provided, because water supply pump is installed outside the slide main body.

DESCRIPTION OF THE PREFERRED EMBODIMENT

Figure 1:
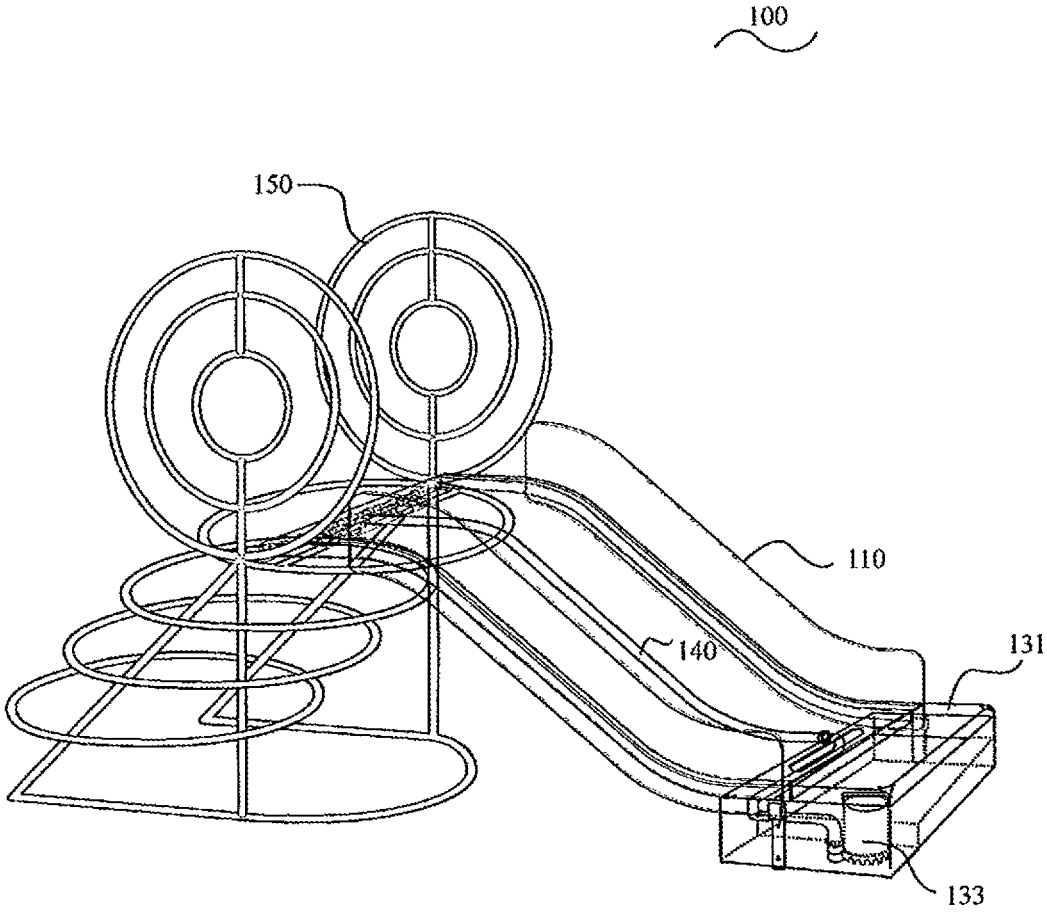
FIG. 1 is a perspective view showing an outlined configuration of slide apparatus in accordance with an embodiment of the present invention.
Figure 2:
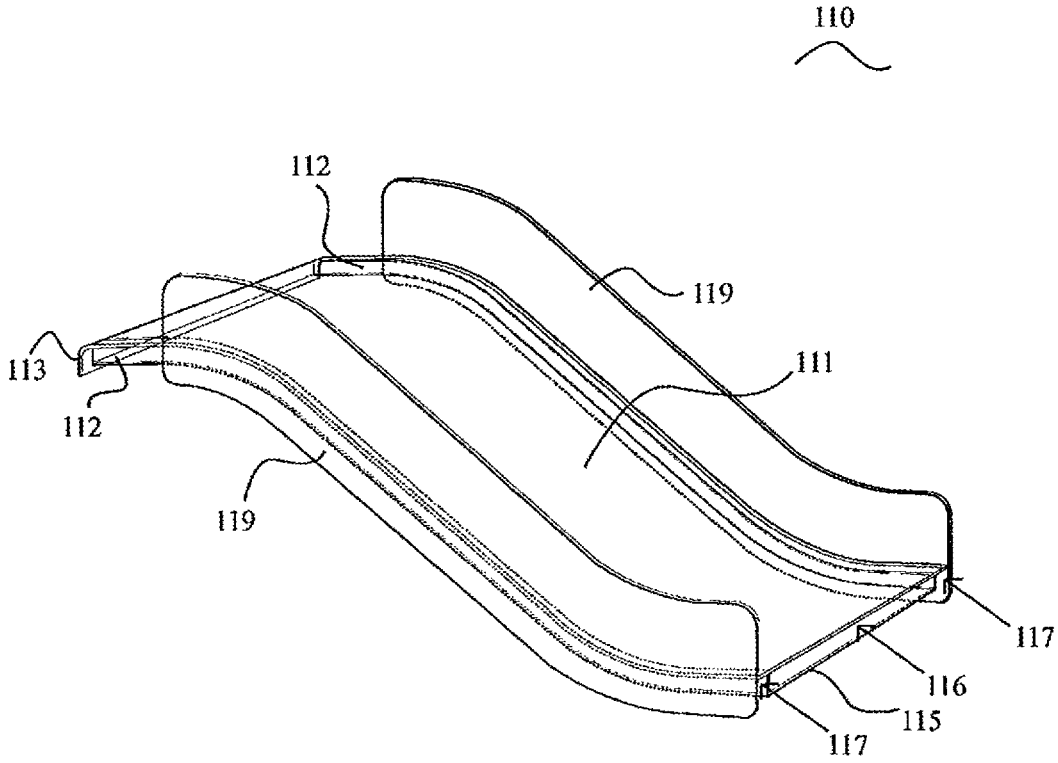
FIG. 2 is a perspective view showing a slide main body of a slide apparatus in accordance with an embodiment of the present invention.
Figure 3:
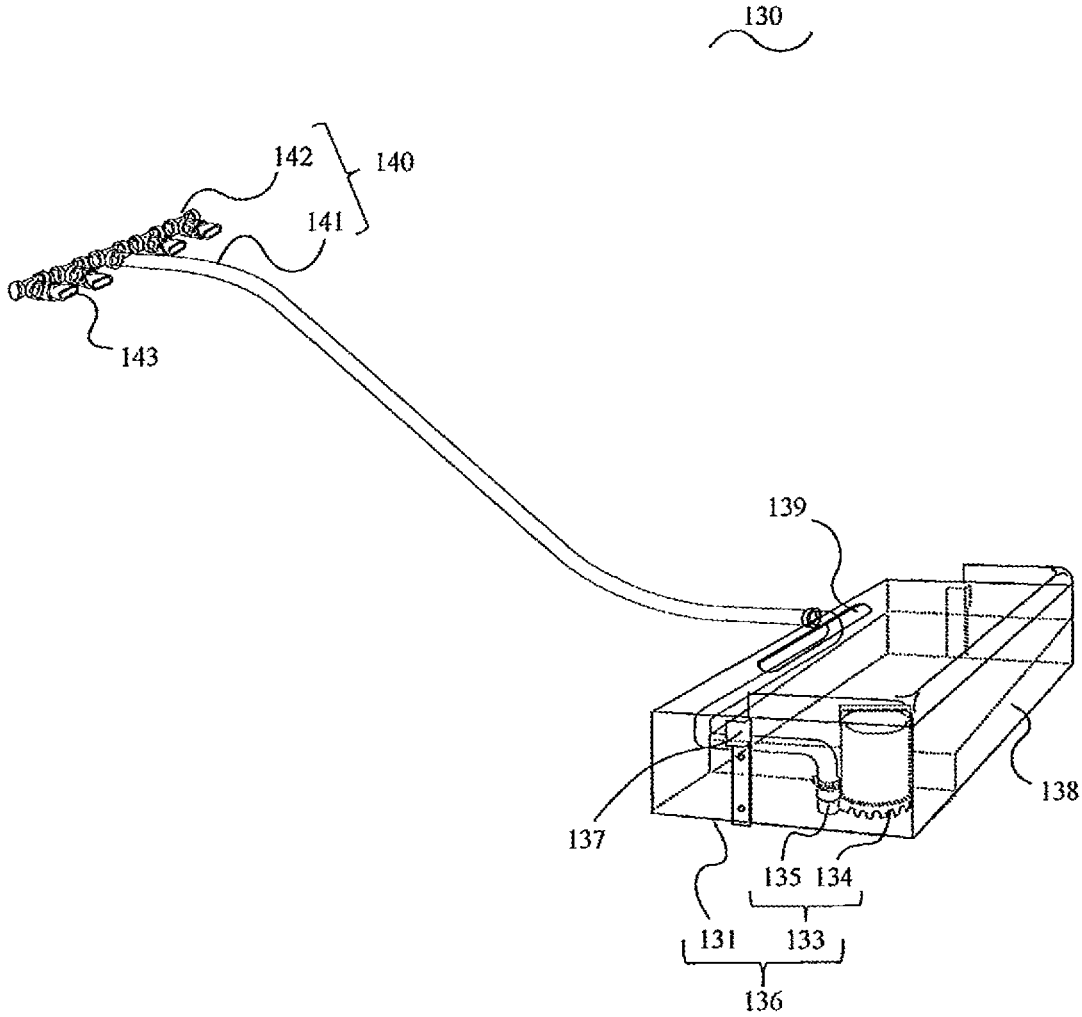
FIG. 3 is view showing a structure for circulating a fluid in a slide main body of a slide apparatus in accordance with an embodiment of the present invention.
Figure 4:
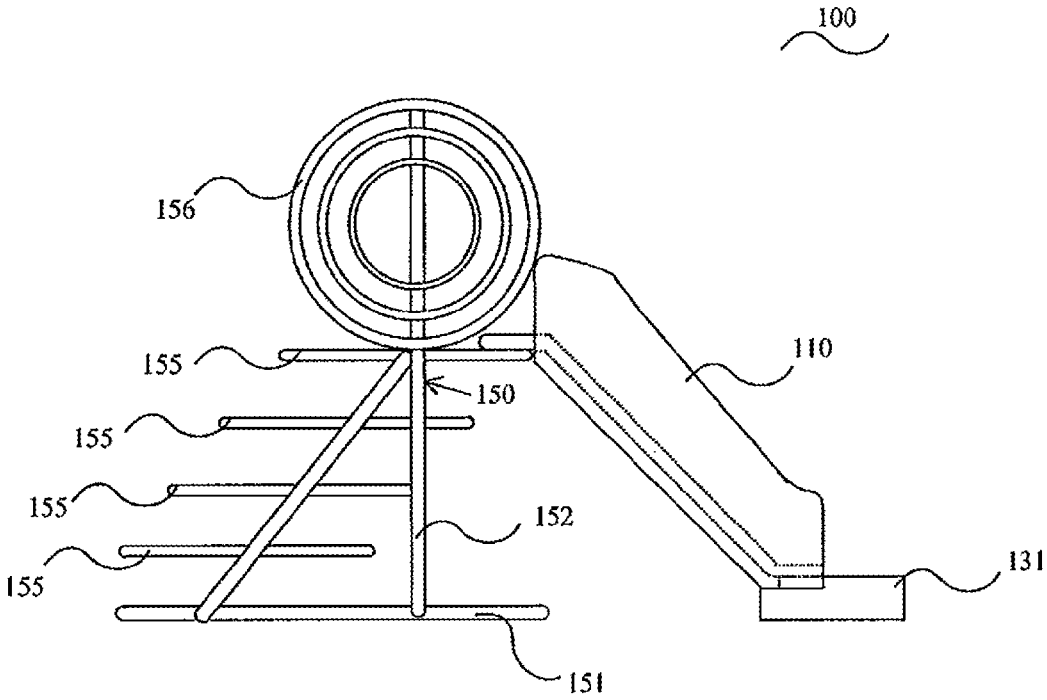
FIG. 4 is a side view and a top view of a slide apparatus in accordance with an embodiment of the present invention.
Figure 4:
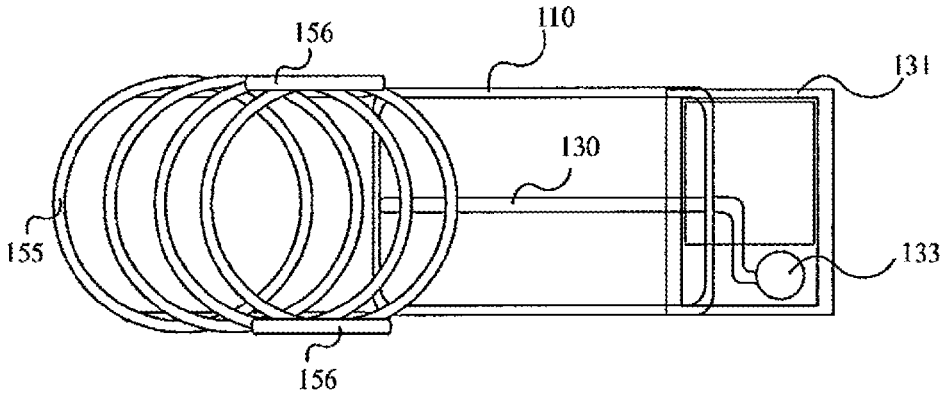
Figure 5:
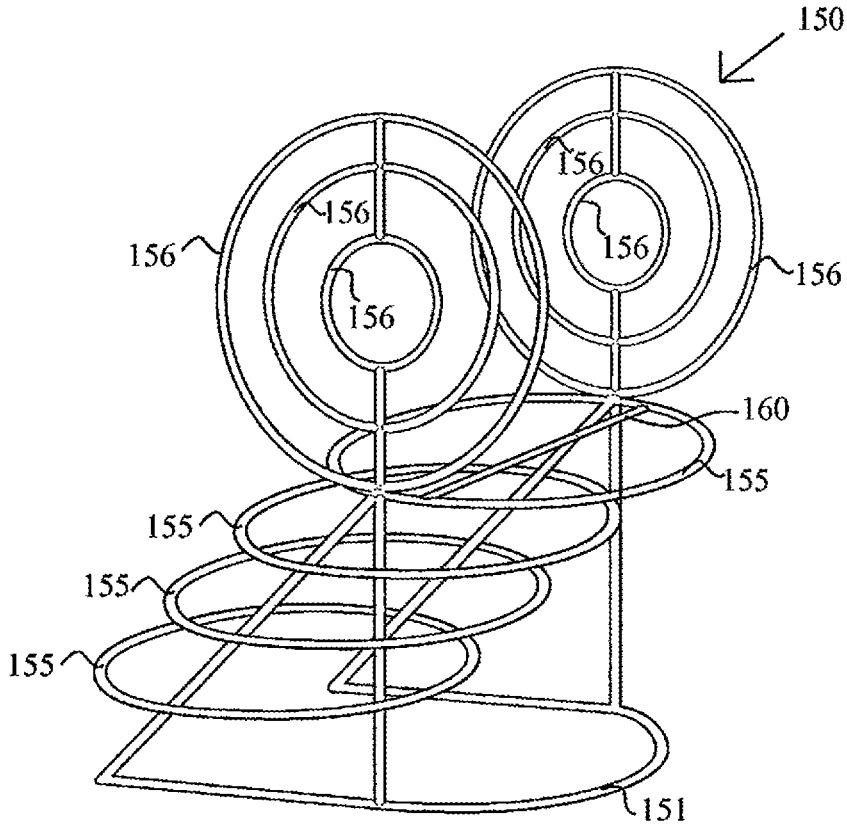
FIG. 5 is a perspective view showing a mounting that is a support of the slide apparatus in accordance with the embodiment of the present invention.

A specified embodiment of a slide apparatus 100 is explained hereinafter with reference to the accompanying drawings. FIG. 1 is an outline schematic view of slide apparatus 100 of the present invention, FIG. 2 is an enlarged schematic view of a slide main body 110, FIG. 3 is an outline schematic view of a flowing water structure 130, FIG. 4 is an outline schematic view of a mounting, and FIG. 5 shows a side view and a top view of the slide apparatus 100. However, the details of the parts which do not directly-relate to the present invention will be omitted.

As shown in FIG. 1, a slide apparatus 100 of the present invention is provided with a slide main body 110 having a parallel hollow center formed in a running surface, and a flowing water structure 130 for draining fluids like water from the upper part into the lower part of the hollow portion of the slide main body 110. The slide main body 110 shown in FIG. 2 is formed as follows. At first, a ramp member having substantially an S-shaped cross-section to the side direction (a satiny shape as possible is preferable) is formed. To the ramp member, it is vertically arranged with lateral members 112 and upper member 113 of a predetermined height, or continuous, it is formed integrally and forms upper slide member 111. The lateral surface members 112 having a specified height, and an upper member 113, are vertically arranged, or integrally and continuously formed to the ramp member, so as to form an upper slide member 111. The lateral members 112 are vertically arranged, or integrally and continuously formed within the specified distance (the distance that an after-mentioned decoration member can be attached to) from the lateral edge of the ramp member. An opening is formed in the lower part of the slide main body 110. Because the slide main body 110 is assembled, in this state the lower part of the ramp member is opened. In addition, a side wall 119 is stood in the sides of the upper part slide member so as to prevent users falling over the side.

An upper part and a lower part of the upper slide member 111 are formed horizontally, so that the horizontal sections can be placed on a mounting 150 and a reservoir 131 as will hereinafter be described when the slide main body 110 is assembled together. The following is an assembling procedure of the slide main body 110: the lateral surface members 112 and the upper member 113 are formed to the upper slide member 111, then a bottom slide member 115 can be fixed to the upper slide member 111. Alternatively, the lateral surface members 112 and the upper member 113 are formed to a bottom slide member 115 then the upper slide member 111 can be fixed to the bottom slide member 115.

In accordance with exemplary embodiments, the lateral surface members 112 and the upper member 113 are vertically arranged or integrally and continuously formed to the upper slide member 111. This is because it prevents screw heads such as screws from projecting into a front side of the upper slide member 111 when the bottom slide member 115 is fixed to the upper slide member 111 with screws as will hereinafter be described. Therefore, the upper slide member 111 and bottom slide member 115 are fixed to the bottom end of the lateral surface members 112 with screws so as to form a slide main body 110 of a hollow structure. The shape of a cross-section on the side of the bottom slide member 115 is molded almost similar to a cross-section on the side of upper slide member 111.

The surface on the upper member 113 and the lateral surface members 112 of the upper slide member 111 become a back side, and a front face becomes the running surface. Then, the bottom slide member 115 is formed, by a specified shorter distance width (substantially same distance between lateral surface members 112) than the upper slide member 111. After-mentioned flowing water structure 130 is incorporated in the upper slide member 111 and the bottom slide member 115 configured as above. Then the slide main body 110 is formed by fixing the bottom slide member 115 and the upper slide member 111. Therefore, the slide main body 110 includes the hollow portion which is parallel to the running surface, an opening 116 is formed in the lower part of the slide main body.

It is fixed hermetically so that water does not leak from the upper member 113, the upper slide member 111, the lateral surface members 112, and the bottom slide member 115 when the bottom slide member 115 is fixed to the upper slide member 111 because slide main body 110 is configured to circulate water by flowing water structure 130 as will hereinafter be described. FIG. 3 is the outline schematic view of the flowing water structure 130 incorporated in the slide main body 110 configured as above. The flowing water structure 130 includes a reservoir 131 for storing water, a water supply device 136 having a water supply pump 133 pumping water from the reservoir 131 and discharging, a pipe 140 for pulling the water up to an upper part of the slide main body 110.

At first, the reservoir 131 to store up water circulated in the slide main body 110 is prepared.

As for reservoir 131, water running down the upper part of the slide main body 110 is placed in the position that can store water as shown in FIG. 1. As illustrated in FIG. 1, reservoir 131 is placed in the position that can store water running from the upper part of slide main body 110. In the present embodiment, a bottom horizontal portion of the slide main body 110 is put on the reservoir 131. A water supply pump 133 is accommodated in the reservoir 131. As shown in FIG. 3, water in the reservoir 131 is pumped from suction opening 134 provided in the water supply pump 133, and is discharged from a discharge opening 135 of water supply pump 133. In the present embodiment, the aperture provided below the water supply pump 133 is suction opening 134, configured to supply water even if little water is in reservoir 131. Also in the present embodiment, a ramp portion 138 having a decline to the suction opening 134 of the water supply pump 133 is provided inside the reservoir 131. Even if there is little water in reservoir 131, by ramp portion 138, the water flows into suction opening 134 of water supply pump 133.

One end of the pipe 140 is connected to the discharge opening 135 of the water supply pump 133. The water discharged out from the discharge opening 135 of the water supply pump 133 is flowed to the another end of the pipe 140. The other end of the pipe 140 is connected to a nozzle 143 provided to a hollow part of the slide main body 110. In the present embodiment, a nozzle 143 is attached to the backside of the upper member 113 of the slide main body 110. The water is discharged from outlet (the part that water is discharged) of nozzle 143, flowing to a hollow part of slide main body 110.

A outlet of the nozzle 143 is formed by smashing one end of a hollow tube up and down. A plural number of nozzles 143 are attached to the backside of the upper member 113 of the slide main body 110. The plurality of nozzles 143 are formed, and attached to the backside of the upper member 113 of the slide main body 110. Of course, the other end of each nozzle 143 is connected to the pipe 140. In accordance with exemplary embodiments, the pipe 140 is put together so as to form a T-shaped part (hereinafter called T-shaped pipe 140), and the upper horizontal pipe 142 of the T-shaped pipe 140 is attached to the backside of upper member 113 of the slide main body 110. A plurality of openings are opened to the upper horizontal pipe 142 of T-shaped pipe 140. The openings are fitted in or connected to the other ends of the nozzles 143.

Pipe 141 of an upper and lower portion in the T-shaped pipe 140 is incorporated on a slope (the backside of the running surface), among hollow parts of the slide main body 110. When the slide main body 110 is put on the reservoir 131, the upper part of the reservoir 131 is covered with a specified lid. A surface of the lid may be coated with an after-mentioned impact absorption member. Opening 139 is formed in the lid, so that the T-shaped pipe 140 can penetrate through the opening 139.

The slide main body 110 configured as above is supported with a support as shown in FIG. 4.

FIG. 4 is side elevation of the slide apparatus 100 of this Invention and a top plan view, and FIG. 5 is an expansion schematic view of mounting 150 (corresponding to the support) supporting the slide main body 110. The mounting 150 is formed as described below. A strut 152 is stood in both sides of a base substrate 151 placed on the floor. A plurality of annular members 155 formed in annular shapes are arranged in an echelon form between both struts 152 at prescribed intervals to each other. That is to say, as shown in FIG. 4 (B), when the mounting is seen from top, each annular member 155 is arranged so as to be deviated in the specified distance between both struts 152. The external diameter of the annular member 155 is formed in placeable distance between both struts 152. A hand rail may be provided to the annular members 155 placed in an echelon form.

A floor covering material (not shown) for preventing the drop of a user is put on an annular member 155 of a halfpace, among the annular members 155 placed between both struts 152. Also a top horizontal portion of the slide main body 110 is put on an annular member 155, thus the height of the entire mounting 150 is adjusted so that the height of the annular member stairhead can receive the slide main body 110. Also the slide main body 110 is put on the reservoir 131, thus the height of the annular member stairhead is adjusted, so that the slide main body 110 can be put between the annular member stairhead and the reservoir 131 installed on the floor. Also a crossbar 160 for supporting the slide main body 110 is provided on the annular member stairhead.

A lateral surface member for holding a user in a standing state is installed to an annular member 155 of the stairhead. In the present embodiment, a pair of annular members (hereinafter called a side annular member 156) is stood in the both sides of an annular member of the stairhead as the lateral surface member. A fall preventing means is provided in the lateral surface member for preventing a user from falling over the side when the user climbed to an upper annular member 155 of the stairhead. For example, a plurality of small annular members (hereinafter mean the diameter of the annular portion) having an external diameter smaller than an inside diameter (forming a different external diameter to each other) of side annular member 156 is formed. And the small annular members are placed so that the central axe of each sized annular members is substantially superimposed on a central axe of the side annular member 156. For example, the strut 152 that it is vertically arranged by the base substrate sides is extended and makes said struts 152 support the small annular members. The struts 152 vertically arranged on the side of the base substrate 151 are extended so that the struts 152 supports each sized annular member. The clearance of the small annular members located in the center is covered with sheets.

A specified shock absorber is coated to the mounting 150. A foam such as urethane is coated to the outer frame of the mounting 150 as this shock absorber. For example, the one side of the side of the shock absorber of the hollow cylinder is cut, so as to be coatable on the stick face. And the shock absorber having been coated on a part of the mounting 150 (e.g., the annular member 155, the part to be expected that a user comes in contact with), and, a gum resin is painted on the surface of the shock absorber, so that water repellent finishing is applied to the surface of the shock absorber. Of course the side (mean cut part) of the shock absorber will be closed when gum resin is painted. The shock absorber may be any composition other than urethane, and shock absorber like foams such as polyethylene is preferably used.

Mounting 150 is coated with the shock absorber so that the shock absorber relaxes shock and prevents an injury effectively even if a user falls from the slide apparatus 100 by mistake. Reservoir 131 may be coated with the shock absorber. A specified decoration can be on the slide main body 110. For example, the width of the bottom slide member 115 of the configured slide main body 110 is formed more narrowly than the width of upper slide member 111. Thus, clearance 117 is left between a border of the bottom slide member 115 and a border of the upper slide member 111 when slide main body 110 is assembled, as shown in FIG. 2. In the present embodiment, a decoration member (e.g., a LED ribbon comprised a plural LEDS) is attached to the clearance 117.

A method of use of the slide apparatus 100 of this Invention will now be explained. At first, the slide main body 110 in which the T-shaped pipe of the flowing water structure 130 is incorporated to the bottom slide member 115 and the upper slide member 111, is put on the mounting 150 and the reservoir 131. That is to say, the slide main body 110 is supported with the reservoir 131 and the mounting 150. Then the reservoir 131 is filled with liquids such as water (hereinafter described with water as an example). And, when the water supply pump 133 in the reservoir 131 is switched on, then the water supply pump 133 operates, water in reservoir 131 is pumped from suction opening 134 of the water supply pump 133, and is discharged from discharge opening 135. The water discharged from pump discharge opening 135 is pulled up to the upper part of slide main body 110 via T-shaped pipe 140 (mean upper and lower pipe 141). And, also the water spouts from a plurality of the nozzles 143 connected to pipe 142 of the top horizontal portion of T-shaped pipe 140. Furthermore, the water spurted from the nozzles 143 is to return in above reservoir 131 through a hollow part of the slide main body 110, and thus water in reservoir 131 circulates through a hollow part of the slide main body 110 via flowing water structure 130. Therefore, water from the nozzle 143 continues spurting out to a hollow part of the slide main body 110 during operation of the water supply pump 133.

The user climbs to a floor covering material provided to an annular member 155 of the stairhead, using the annular members 155 arranged in an echelon form of the mounting 150. At this time, the user holds on the lateral surface member (mean side annular member 156 and small annular members), and can stand with stability. And, the user slides down a running surface of the slide main body 110 spurting out water from nozzles 143, and thus that can make a user feel so-called waterfall sliding (mean water slide).

Water supply pump 133 pumps water from the suction opening 134 by pressure application, and thus quantity and force of water flowing through a hollow part of slide main body 110 can be changed by controlling a pressure of the water supply pump 133. As discussed above, the slide apparatus 100 of this Invention can make a feeling that a user does a water slide, without requiring a large quantity of water. Also this Invention provides the water supply pump 133 of the slide apparatus 100 outside the slide main body 110. Thus the playground equipment which can easily perform the maintenance such as repair and change of water supply pump 133 can be provided. Industrial applicability This invention is useful for providing a slide apparatus which can make a feeling that a user does a water slide. Also, the slide apparatus of this Invention is useful for being installed in a room easily, because it require no large quantity of water. In addition, a playground equipment with excellent ability of maintenance such as repair and change can be provided, because water supply pump is installed outside the slide main body. Therefore, the industrial applicability is provided. The embodiments and implementations that have been disclosed here are illustrative by nature are should not be regarded as limiting. The scope of the invention is defined by its claims rather than the foregoing description, and should be understood to include the features of the claims of the invention and equivalents thereof, in addition to all changes falling within the scope of the claims.

What is claimed is:

1. A slide apparatus comprising:

a slide main body having a hollow structure open at a lower forward portion;

a reservoir supporting the lower portion of the slide main body;

a fluid supply pump provided in the reservoir;

a pipe placed in a hollow portion of the slide main body, one end of the pipe connected to a discharge opening of the fluid supply pump, and the other end of the pipe extended to an upper inside of the slide main body, the pipe extending through the hollow portion of the slide main body from the lower portion of the slide main body to the upper inside of the slide main body;

a nozzle connected to the other end of the pipe;

a support supporting an upper portion of the slide main body;

the nozzle spurting fluid from the reservoir delivered via the pipe, the reservoir receiving the spurting fluid, the spurting/receiving is repeated.

2. The slide apparatus according to claim 1 further comprising:

a ramp portion provided in the reservoir;

the fluid supply pump having a suction opening placed below the ramp portion.

3. The slide apparatus according to claim 1, wherein the support is a mounting arranged in an echelon form, a member provided on a upper part of the mounting for preventing a user from falling.

4. The slide apparatus according to claim 1 further comprising, a shock absorber for coating a part of the slide apparatus;

a gum resin applied to a surface of the shock absorber.

5. The slide apparatus according to claim 4, wherein the shock absorber is urethane.

6. The slide apparatus according to claim 1, wherein the reservoir has at least a portion located in front of the slide main body.

* * * * *